US005970663A

United States Patent [19]

McDonough

[11] Patent Number: 5,970,663

[45] Date of Patent: Oct. 26, 1999

[54] STORAGE SHED FOR PROVIDING EASY ACCESS TO TOOLS AND RELATED ITEMS THROUGH A SYSTEM OF SHELVES AND HOLDERS

[76] Inventor: Michael C. McDonough, 9439 Calle Vejar, Rancho Cucamomga, Calif. 91730

[21] Appl. No.: 08/673,508

[22] Filed: Jul. 1, 1996

[51] Int. Cl.[6] ..... A47B 81/00

[52] U.S. Cl. ..... 52/36.4; 52/79.1; 52/79.5; 211/70.6; 312/100

[58] Field of Search ..... 52/36.4, 79.1, 52/79.5, 64; 312/245, 100, 101, 242, 128, 351, 902; 211/70.6, 134, 153, 187, 162, 193

[56] References Cited

U.S. PATENT DOCUMENTS

| | | | |
|---|---|---|---|
| 859,683 | 7/1907 | McDowell, Sr. | 211/134 X |
| 1,944,394 | 1/1934 | Bales et al. | 211/134 X |
| 2,697,804 | 12/1954 | Phelon | 211/70.6 X |
| 3,748,009 | 7/1973 | Stone | 312/263 |
| 3,915,308 | 10/1975 | Ratzloff et al. | 211/70.6 X |
| 3,921,812 | 11/1975 | Hamrock et al. | 211/70.6 |
| 4,118,085 | 10/1978 | Fibus | 312/245 |
| 4,681,233 | 7/1987 | Roth | 211/70.6 |
| 5,294,196 | 3/1994 | Chen | 312/263 |
| 5,322,256 | 6/1994 | Kanwischer | 211/70.6 X |

*Primary Examiner*—Christopher Kent

[57] ABSTRACT

A storage shed for providing easy access to tools and related items. Such shed includes a vertical imperforate back wall positionable at an elevated location with respect to a recipient surface such as the wall of a house. In association with the back wall are a front wall and parallel vertical side edges. A top edge is positionable parallel with the top edge of the back wall. The front wall has at least one large rectangular opening therein. Side walls couple the front and back walls. At least one door is positionable over a respective opening in the front wall. A pair of vertical side braces are located in the space formed between the front and rear walls and secured to the lateral side walls. The braces have horizontal slots at spaced elevations for shelf-receiving purposes, the slots being positioned in facing relationship in the braces. A plurality of shelves with lateral edges are received in the slots of the braces. A plurality of horizontal U-shaped rail sections have free ends in contact with the back wall and are located between opposed braces. The rail sections have horizontally aligned apertures along their lengths.

1 Claim, 4 Drawing Sheets

Fig. 9
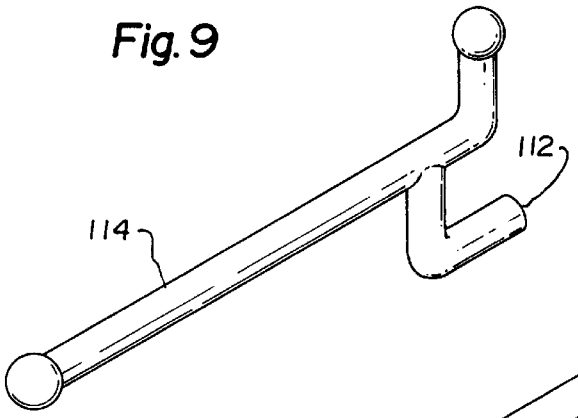
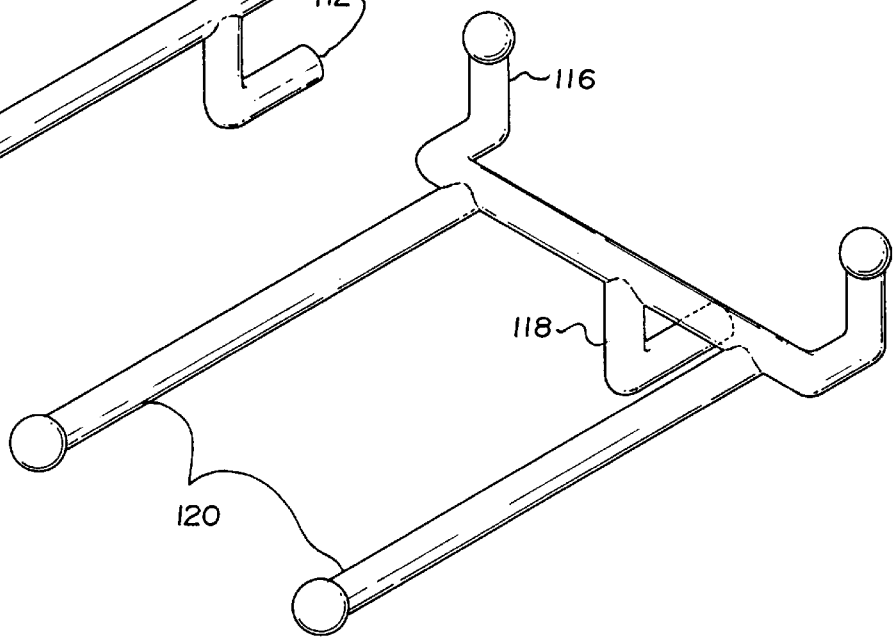
Fig. 10
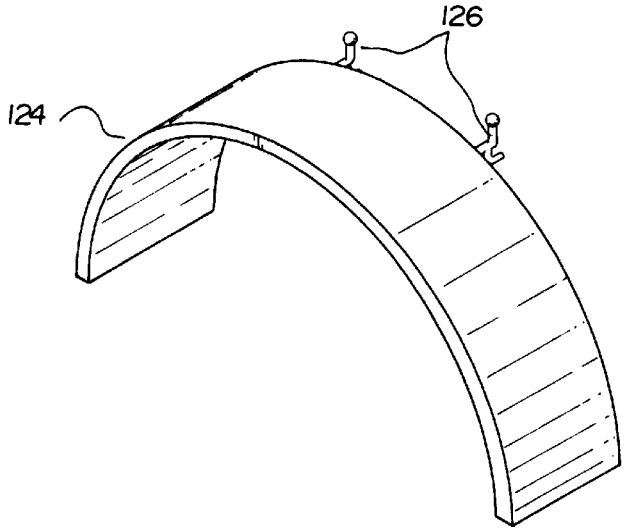
Fig. 11

STORAGE SHED FOR PROVIDING EASY ACCESS TO TOOLS AND RELATED ITEMS THROUGH A SYSTEM OF SHELVES AND HOLDERS

BACKGROUND OF THE INVENTION

1. Field of the Invention

The present invention relates to a storage shed and, more particularly, pertains to providing easy access to tools and related items through a system of shelves and holders.

2. Description of the Prior Art

The use of sheds and storage areas of various designs and configurations is known in the prior art. More specifically, sheds and storage areas of various designs and configurations heretofore devised and utilized for the purpose of providing access to tools, gardening items and like objects through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art in U.S. Pat. No. 4,467,925 to Ratzloff et al. discloses a wheelbarrow and garden tool storage rack.

U.S. Pat. No. 5,143,228 to Arnold discloses a garden equipment support rack.

U.S. Pat. No. 4,166,343 to O'Brien et al. ad discloses collapsible supports with storage shed utility purposes.

U.S. Pat. No. 3,985,324 to Larson discloses a tool holder for pegboard.

U.S. Pat. No. Des. 329,705 to Forsyth discloses an ornamental design for a shed.

U.S. Pat. No. Des. 329,707 to Embree et al. discloses a slotted wall strip.

Lastly, U.S. Pat. No. 4,912,891 to Bertrand discloses a folding building structure.

In this respect, the storage shed for providing easy access to tools and related items through a system of shelves and holders according to the present invention substantially departs from the conventional concepts and designs of the prior art, and in so doing provides an apparatus primarily developed for the purpose of providing easy access to tools and related items through a system of shelves and holders.

Therefore, it can be appreciated that there exists a continuing need for a new and improved storage shed for providing easy access to tools and related items through a system of shelves and holders which can be used for providing easy access to tools and related items through a system of shelves and holders. In this regard, the present invention substantially fulfills this need.

SUMMARY OF THE INVENTION

In view of the foregoing disadvantages inherent in the known types of sheds and storage areas of various designs and configurations now present in the prior art, the present invention provides an improved storage shed for providing easy access to tools and related items through a system of shelves and holders. As such, the general purpose of the present invention, which will be described subsequently in greater detail, is to provide a new and improved storage shed for providing easy access to tools and related items through a system of shelves and holders and method which has all the advantages of the prior art and none of the disadvantages.

To attain this, the present invention essentially comprises a new and improved storage shed for providing easy access to tools and related items through a system of shelves and holders comprising, in combination, a vertical imperforate back wall in a generally rectangular configuration positionable at an elevated location with respect to a recipient surface such as the wall of a house, the back wall having a horizontal bottom edge, parallel vertical side edges and a horizontal top edge; a front wall in a generally rectangular configuration having a horizontal bottom edge positionable at a common elevation as the bottom edge of the back wall, parallel vertical side edges positionable spaced from but in alignment with the side edges of the back wall and a top edge positionable parallel with but at a lower elevation than the top edge of the back wall, the front wall having two large rectangular openings therein with a vertical strip therebetween; side walls including lateral side walls and an upper and lower side wall coupling the front and back walls to form a generally rectilinear enclosure but with a sloping roof; a pair of doors positionable over respective openings in the front wall with hinges thereon adjacent to the lateral side walls and with handles and locks positionable adjacent the intermediate vertical strip; a pair of vertical side braces in the space formed between the front and rear walls and secured to the lateral side walls, the braces having interior edges in contact with the rear wall and having exterior edges located at an intermediate location between the front and rear walls, the braces having horizontal slots at spaced elevations for shelf-receiving purposes, the slots being positioned in facing relationship in the braces; a plurality of shelves with lateral edges received in the slots of the braces; a plurality of horizontal U-shaped rail sections having free ends in contact with the back wall and located between opposed braces, the rail sections having horizontally aligned apertures along their lengths; a plurality of hangers having L-shaped members with long horizontal sections and short upturned vertical sections positionable in the apertures of the rail sections and with lower L-shaped sections having vertical portions extending downwardly from the horizontal sections and with short horizontal sections positionable beneath the rail sections; and holder components positioned on the ends of the hangers remote from the rail sections, the holders including clips, loops, shelf supports, magnets and hose hangers.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved storage shed for providing easy access to tools and related items through a system of shelves and holders which has all the advantages of the prior art sheds and storage areas of various designs and configurations and none of the disadvantages.

It is another object of the present invention to provide a new and improved storage shed for providing easy access to tools and related items through a system of shelves and holders which may be easily and efficiently manufactured and marketed.

It is a further object of the present invention to provide a new and improved storage shed for providing easy access to tools and related items through a system of shelves and holders which is of a durable and reliable construction.

An even further object of the present invention is to provide a new and improved storage shed for providing easy access to tools and related items through a system of shelves and holders which is susceptible of a low cost of manufacture with regard to both materials and labor, and which accordingly is then susceptible of low prices of sale to the consuming public, thereby making such sheds and storage areas of various designs and configurations economically available to the buying public.

Even still another object of the present invention is to provide easy access to tools and related items through a system of shelves and holders.

Lastly, it is an object of the present invention to provide a storage shed for providing easy access to tools and related items comprising a vertical imperforate back wall in a generally rectangular configuration positionable at an elevated location with respect to a recipient surface such as the wall of a house, the back wall having a horizontal bottom edge, parallel vertical side edges and a horizontal top edge; a front wall in a generally rectangular configuration having a horizontal bottom edge positionable at a common elevation as the bottom edge of the back wall, parallel vertical side edges positionable spaced from but in alignment with the side edges of the back wall and a top edge positionable parallel with the top edge of the back wall, the front wall having at least one large rectangular opening therein; side walls including lateral side walls and an upper and lower side wall coupling the front and back walls to form a generally rectilinear enclosure; at least one door positionable over a respective opening in the front wall with hinges thereon adjacent to the lateral side walls and with handles and locks positionable adjacent the intermediate vertical strip; a pair of vertical side braces in the space formed between the front and rear walls and secured to the lateral side walls, the braces having interior edges in contact with the rear wall and having exterior edges located at an intermediate location between the front and rear walls, the braces having horizontal slots at spaced elevations for shelf-receiving purposes, the slots being positioned in facing relationship in the braces; a plurality of shelves with lateral edges received in the slots of the braces; and a plurality of horizontal U-shaped rail sections having free ends in contact with the back wall and located between opposed braces, the rail sections having horizontally aligned apertures along their lengths.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an alternate type of holder shown as a single prong hanger.

FIG. 10 is an alternate type of holder shown as a double prong hanger.

FIG. 11 is a perspective view of an alternate type of holder shown as a hose hanger.

The same reference numerals refer to the same parts throughout the various Figures.

DESCRIPTION OF THE PREFERRED EMBODIMENT

Figure 1:
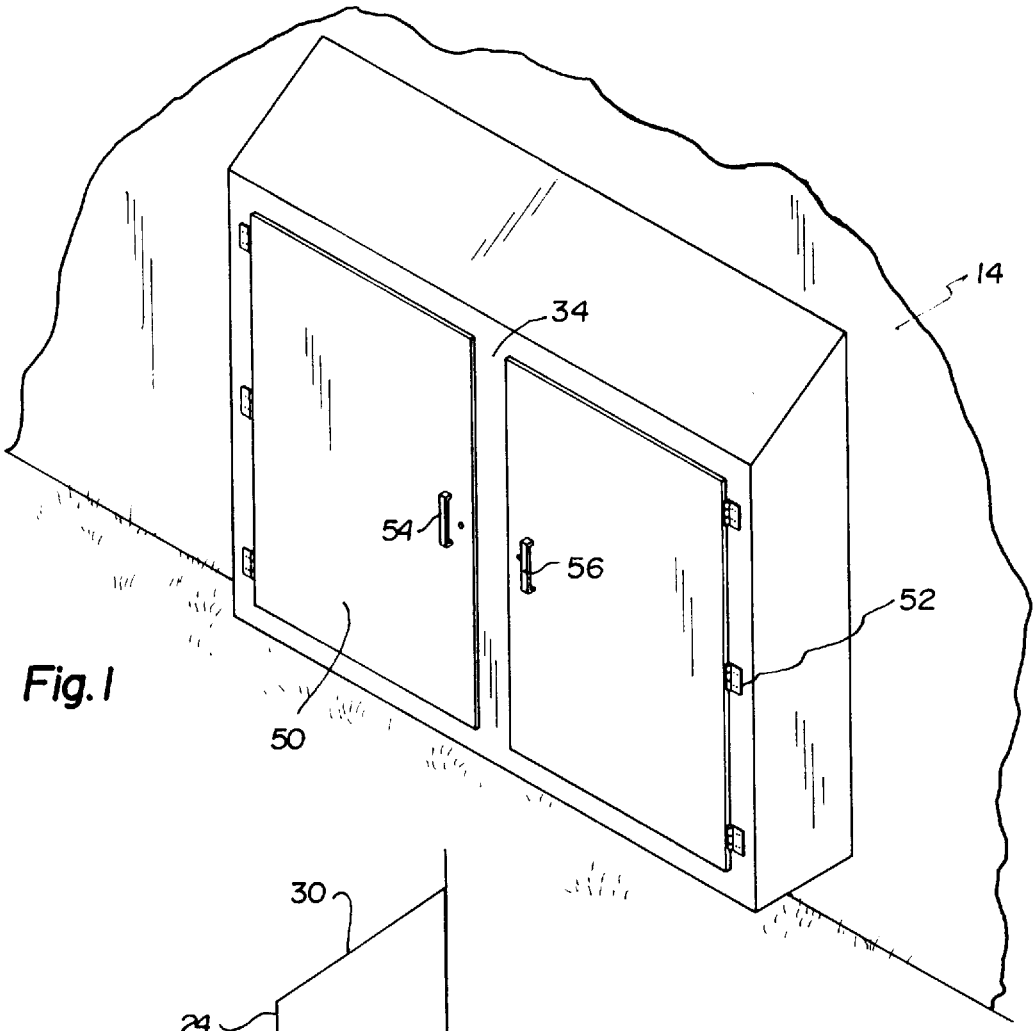
FIG. 1 is a perspective illustration of the preferred embodiment of the new and improved storage shed for providing easy access to tools and related items through a system of shelves and holders constructed in accordance with the principles of the present invention.
Figure 2:
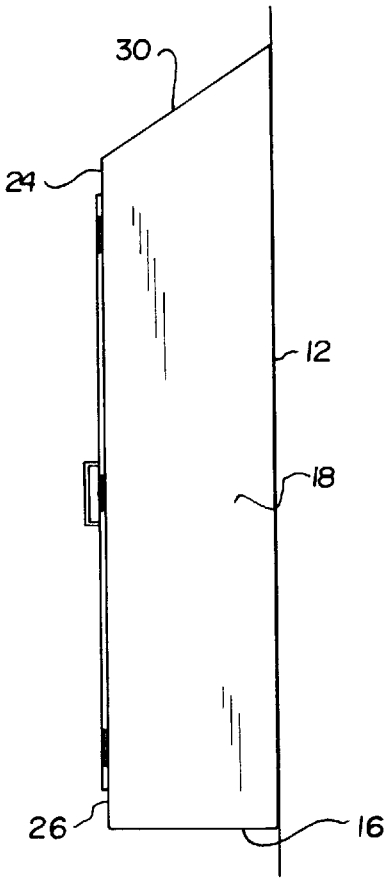
FIG. 2 is a side elevational view of the shed shown in FIG. 1.
Figure 3:
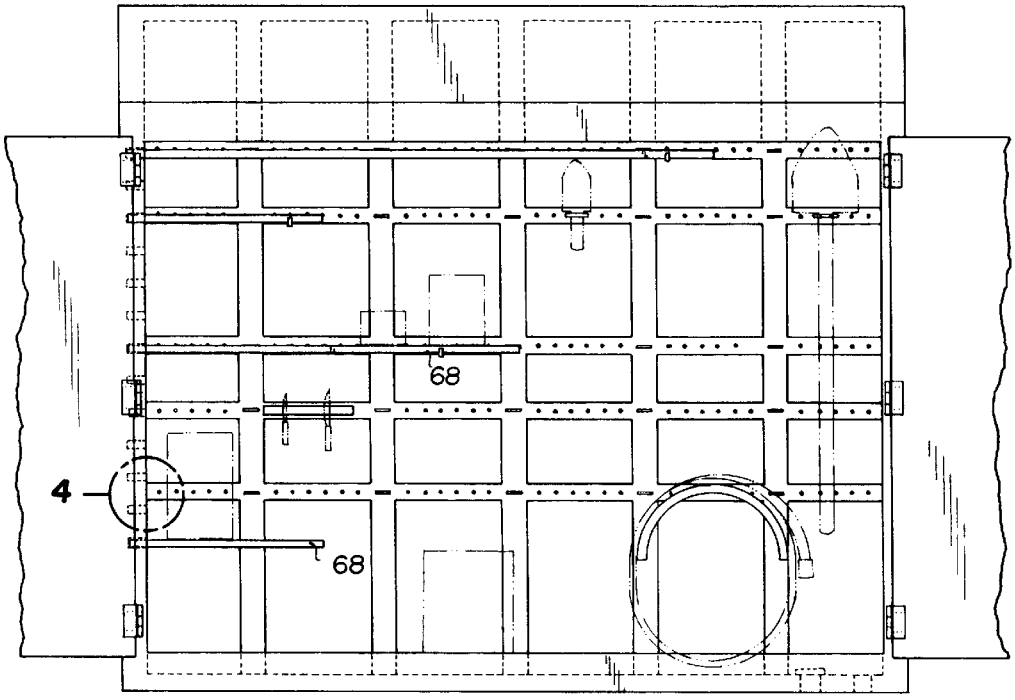
FIG. 3 is a front elevational view of the shed shown in the prior Figures but with the doors open.
Figure 4:
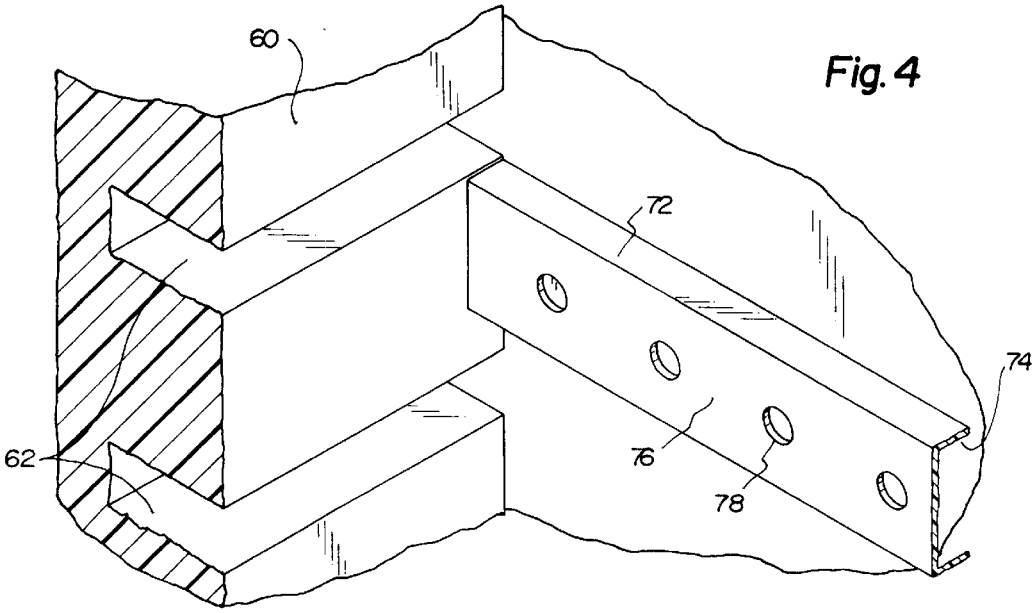
FIG. 4 is an enlarged perspective view of one portion of the shed taken at circle 4 of FIG. 3.

With reference now to the drawings, and in particular to FIG. 1 thereof, the preferred embodiment of the new and improved storage shed for providing easy access to tools and related items through a system of shelves and holders embodying the principles and concepts of the present invention and generally designated by the reference numeral 10 will be described.

The present invention, the new and improved storage shed 10 for providing easy access to tools and related items through a system of shelves and holders, is comprised of a plurality of components. In their broadest context, the components include a back wall, a front wall, side walls, a pair of doors, a pair of side braces, shelves, rail sections, hangers and holder components. Each of the individual components is specifically configured and correlated one with respect to the other so as to attain the desired objectives.

More specifically, the primary component of the system 10 of the present invention is a housing which has as a major component an imperforate back wall 12. The back wall is vertically oriented. It is constructed in a generally rectangular configuration. It is preferably positioned at an elevated location with respect to a recipient surface such as the wall 14 of a house, garage or the like. Coupling is preferably through nails. The back wall has a horizontal bottom edge 16, parallel side edges 18, and a horizontal top edge 20 parallel with the bottom edge.

Next provided is a front wall 24. Such front wall is also in a generally rectangular configuration of a size slightly smaller in height than the back wall. The front wall has a horizontal bottom edge 26 positionable at a common elevation as the bottom edge of the back wall. The front wall also has vertically disposed parallel side edges 28 which are positioned spaced from the side edges of the back wall but in alignment therewith. In addition, a top edge 30 is positioned parallel with but at a lower elevation than the top edge of the back wall. The front wall is also formed to have two large rectangular openings 32, preferably of the same size. Such openings constitute about 90 percent or greater of the entire peripheral area of the front wall. A vertical strip 34 is located between the openings.

Coupling the front wall and the rear wall are a pair of similarly configured side walls 38. The side walls include two lateral side walls 40, 42 and, in addition, an upper side wall 44 and a lower side wall 46. All of such side walls are in a generally rectangular configuration. Together the side walls in combination with the front and back walls form a generally rectilinear enclosure but with a forwardly sloping roof.

The exterior of the enclosure also includes a pair of similarly configured rectangular doors 50. Such doors are positionable over the respective openings in the front wall. The doors have hinges 52 thereon adjacent to the lateral side walls. The doors are also provided with handles 54 and, preferably, locks 56 positionable adjacent to the intermediate vertical strip.

Within the enclosure are a pair of vertical side braces 60. Such side braces are located in the space formed between the front and rear walls. They are secured to the lateral side walls. The braces have interior edges in contact with the rear wall. The braces also have exterior edges located at an intermediate location at about the midpoint between the front and rear walls in contact with the side walls. Such braces are formed with horizontal slots 62 along their entire length. They are spaced at elevations for shelf receiving purposes as will be later described. The slots in the two side braces are at common elevational orientations and face in a mutual facing relationship with the slots of the other brace.

Adapted to be received by the slots in the enclosure are a plurality of shelves 66. The shelves may be of a width equal to the width of the front and back walls and be supported at their opposite ends by the slots of the braces. In the alternative, the shelves may include shorter shelves 68 wherein one edge may be received by a slot and the other edge held in position by a holder as will be later described.

Coupled with respect to the back wall of the enclosure are a plurality of horizontal U-shaped rail sections 72. Such rail sections have parallel free ends 74 in contact with the back wall and couple thereto as by nails. The rail sections are preferably of plastic and are preferably located from side brace to side brace to extend their utility. The rail sections have vertical front faces 76 with a plurality of apertures 78 spaced along their length in a horizontal alignment preferably along the entire length of the rail sections.

Next provided are a plurality of holders 82. Common to all such holders is an L-shaped member 84 with a long horizontal section 86 and a short upturned vertical section 87. The vertical section is provided with a generally spherical enlargement 88 at its upper ends and is sized for being inserted into an associated aperture of a rail section. This allows for convenient repositioning of the holder to accommodate a particular application or applications as desired by the user. Each holder also includes a lower L-shaped section with a vertical portion 90 extending downwardly from an intermediate point of the horizontal section and with a short horizontal section 92. Such short horizontal section is positionable beneath the associated rail section for support.

Figure 5:
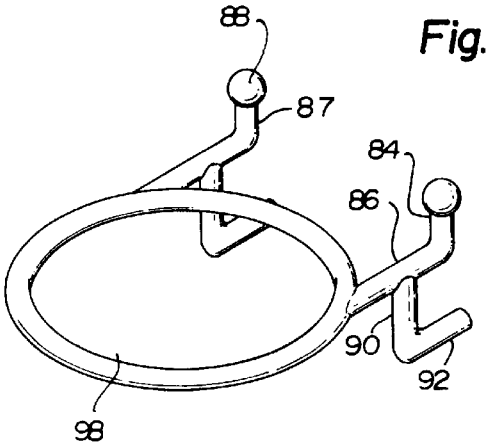
FIG. 5 is a perspective illustration of one type of holder, a loop hanger utilized in the shed of the prior Figures.

In addition to the holders, also provided are a plurality of holder components 96. Such holder components are positioned on the ends of the hangers remote from the rail sections. The holders may take any of a variety of configurations. Note FIGS. 5 through 11. In FIG. 5, for example, the holder is formed as a circular loop 98. Its positioning on a rail section is by a pair of parallel hangers.

Figure 6:
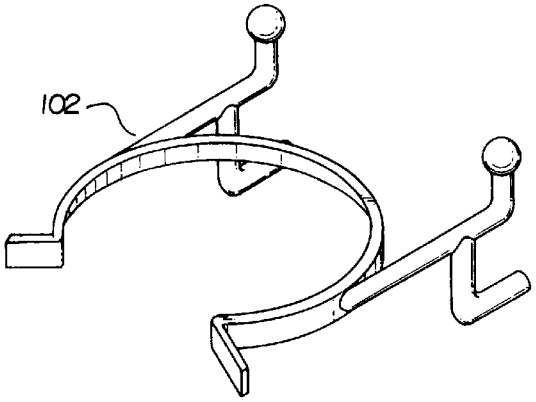
FIG. 6 is an alternate type of holder shaped as a clip hanger.

The FIG. 6 embodiment is similar except that the holder 102 is formed in a generally C-shaped configuration. The preferred material for the holders and hangers is plastic. This allows the C-shaped member of FIG. 6 to be sprung outwardly for receiving a cylindrical member such as a tool handle.

Figure 7:
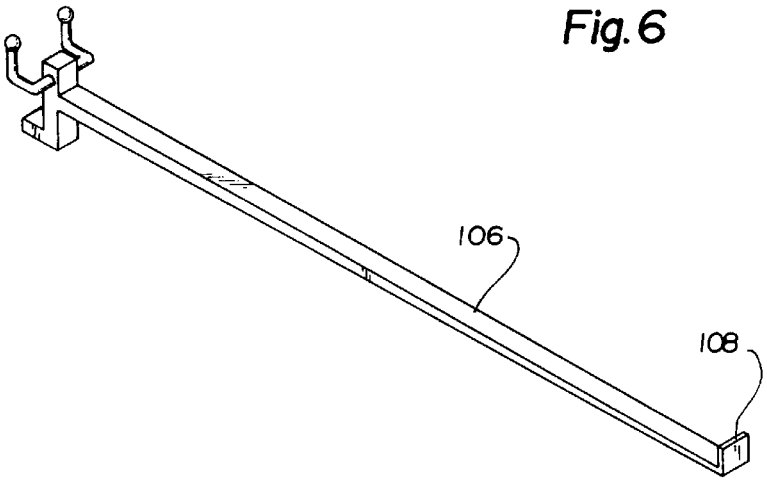
FIG. 7 is an alternate type of holder formed as a shelf support.
Figure 8:
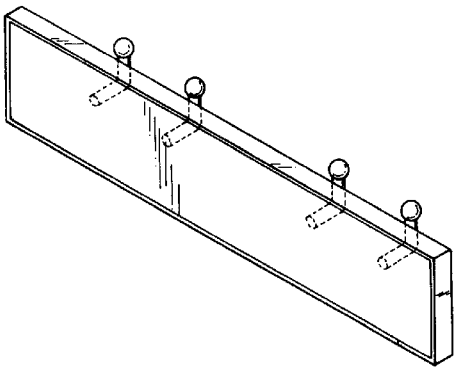
FIG. 8 is an alternate type of holder shown as a magnetic hanger.

In the FIG. 7 embodiment, the holder is formed as an elongated rod 106 with an upturned exterior end 108. Such shelf support is preferably supported by a composite hanger with two upstanding portions and one depending portion. Any of the hanger configurations of FIGS. 5, 6 and 7 assist to preclude rotation of the holder. The elongated nature of the holder in FIG. 7 allows for the support of a shelf at a location remote from a side brace.

The FIG. 9 embodiment is a very simplified form of hanger and holder with a single hanger 112 and a simple single rod-like holder 114 as for receiving the loop or aperture in a garden tool or the like. The FIG. 10 embodiment is similar to that of FIG. 9 except that it has two upwardly extending portions 116 to the hanger and one downwardly extending portion 118 and with a pair of parallel rods 120 extending outwardly therefrom for the support of an object thereon.

Lastly provided is a hose hanger 124 shown in FIG. 11. Such hose hanger has a pair of hangers 126 removably attached to a rail section and a semi-circular member for receiving and supporting a coiled hose.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shed for providing easy access to tools and related items through a system of shelves and holders comprising, in combination:

a vertical imperforate back wall in a generally rectangular configuration positionable at an elevated location with respect to a recipient surface such as the wall of a house, the back wall having a horizontal bottom edge, parallel vertical side edges and a horizontal top edge;

a front wall in a generally rectangular configuration having a horizontal bottom edge positionable at a common elevation as the bottom edge of the back wall, parallel vertical side edges of the back wall and a top edge positionable parallel with but at a lower elevation than the top edge of the back wall, the front wall having two large rectangular openings therein with a vertical strip therebetween;

side walls including lateral side walls and an upper and lower side wall coupling the front and back walls to form a generally rectilinear enclosure but with a sloping roof;

a pair of doors positionable over respective openings in the front wall with hinges thereon adjacent to the lateral side walls and with handles and locks positionable adjacent the intermediate vertical strip;

a pair of vertical side braces in a space formed between the front and rear walls and secured to the lateral side walls, the braces having interior edges in contact with the rear wall and having exterior edges located at an intermediate location between the front and rear walls, the braces having horizontal slots at spaced elevations for shelf-receiving purposes, the slots being positioned in facing relationship in the braces;

a plurality of shelves with lateral edges received in the slots of the braces;

a plurality of horizontal U-shaped rail sections having free ends in contact with the back wall and located between the braces, the rail sections having horizontally aligned apertures along lengths of the rail sections;

a plurality of hangers having L-shaped members with long horizontal sections and short upturned vertical sections positioned in the apertures of the rail sections and with lower L-shaped sections having vertical portions extending downwardly from the horizontal sections and with short horizontal sections positioned beneath the rail sections; and holder components positioned on ends of the hangers remote from the rail sections, the holder components including a horizontally disposed hoop coupled between two hangers, a C-shaped holder disposed in a horizontal plane between two of the hangers, an elongated rod having an upturned free end, an elongated support having a magnetic outer surface, a single and a double prong hanger, and an arcuate support dimensioned for supporting a hose thereon.

* * * * *